US005651510A

United States Patent [19]

Eble et al.

[11] Patent Number: 5,651,510

[45] Date of Patent: Jul. 29, 1997

[54] APPARATUS AND METHOD FOR SPOOLING STRANDED MATERIAL

[76] Inventors: Robert L. Eble; Lola I. Eble, both of 81-324 Palmyra Ave., Indio, Calif. 92201

[21] Appl. No.: 592,195

[22] Filed: Jan. 26, 1996

[51] Int. Cl.[6] ..... B65H 75/30; B65H 75/38; B65H 49/00; B65H 49/18

[52] U.S. Cl. ..... 242/395; 242/129; 242/130.4; 242/137.1; 242/158 R; 242/599; 242/599.3; 242/597.2

[58] Field of Search ..... 242/128, 140, 242/139, 137.1, 130.4, 157 R, 157.1, 157 C, 127, 129, 395, 397.2, 599, 158 R, 615.1, 599.3

[56] References Cited

U.S. PATENT DOCUMENTS

| | | | |
|---|---|---|---|
| 542,220 | 7/1895 | Hedge . | |
| 1,039,820 | 10/1912 | Sawyer | 242/599.3 X |
| 1,061,947 | 5/1913 | Phillips | 242/157.1 X |
| 1,174,637 | 3/1916 | Stupfell . | |
| 1,278,528 | 9/1918 | Van Rensselaer . | |
| 1,290,577 | 1/1919 | Kinney . | |
| 1,381,791 | 6/1921 | Byrd | 242/130.4 X |
| 1,505,623 | 8/1924 | Burton . | |
| 2,536,931 | 1/1951 | Harward . | |
| 3,066,886 | 12/1962 | Beaver et al. | 242/130.4 |
| 4,063,694 | 12/1977 | Lemin | 242/129 X |
| 4,143,832 | 3/1979 | Platt | 242/157.1 X |
| 4,378,095 | 3/1983 | Reynolds | 242/599.3 X |
| 4,634,077 | 1/1987 | Wilson . | |
| 4,941,622 | 7/1990 | Alexander | 242/130.4 X |
| 4,955,557 | 9/1990 | Sewell et al. . | |

*Primary Examiner*—Michael Mansen
*Attorney, Agent, or Firm*—Sheldon & Mak

[57] ABSTRACT

Apparatus and method for managing stranded media for hand-working includes a base frame; a vertical spindle unit having a shaft, and first and second flanges. A guide for the media is manually movable during operation of the crank for axially dispersing portions of the media being rewound between opposite ends of the spindle, the guide being selectively held stationary in an intermediate position for dispensing the media through the guide with limited axial displacements of the media from the supply. The apparatus can include a crank on the spindle shaft, part of the frame extending near the crank for manual support of the apparatus while cranking. The guide can be biased in one direction, and a control member coupled to the guide for movement in the other direction in response to downward finger pressure for rewinding with one hand turning the crank and the other hand holding the frame and moving the control member. The spindle unit can include a removable temporary core, a guide pin being axially connectable to the temporary core in flush relation to the temporary core when it is removed from the first flange, the guide pin having a smoothly blunt tapered end profile for piercing a skein of the media without damage to the stranded media. Another configuration has the blunt end profile on a solid spindle shaft that is received in the frame by temporarily deflecting the frame, rewinding being facilitated by a second horizontal orientation of the spindle.

18 Claims, 4 Drawing Sheets

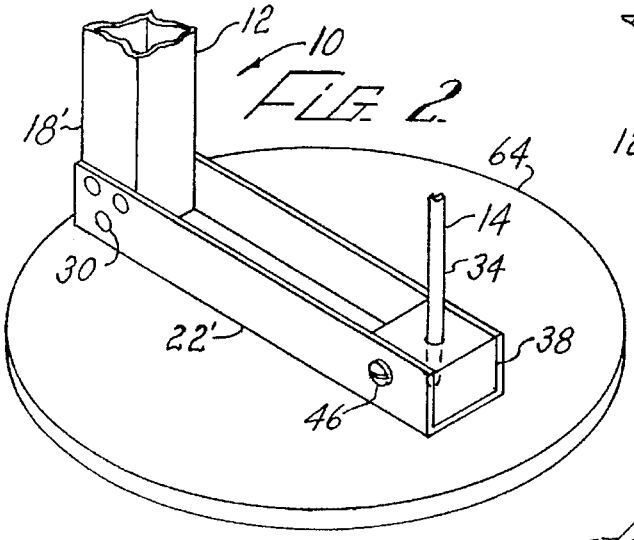
FIG. 2
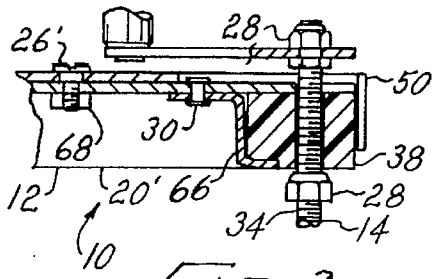
FIG. 3
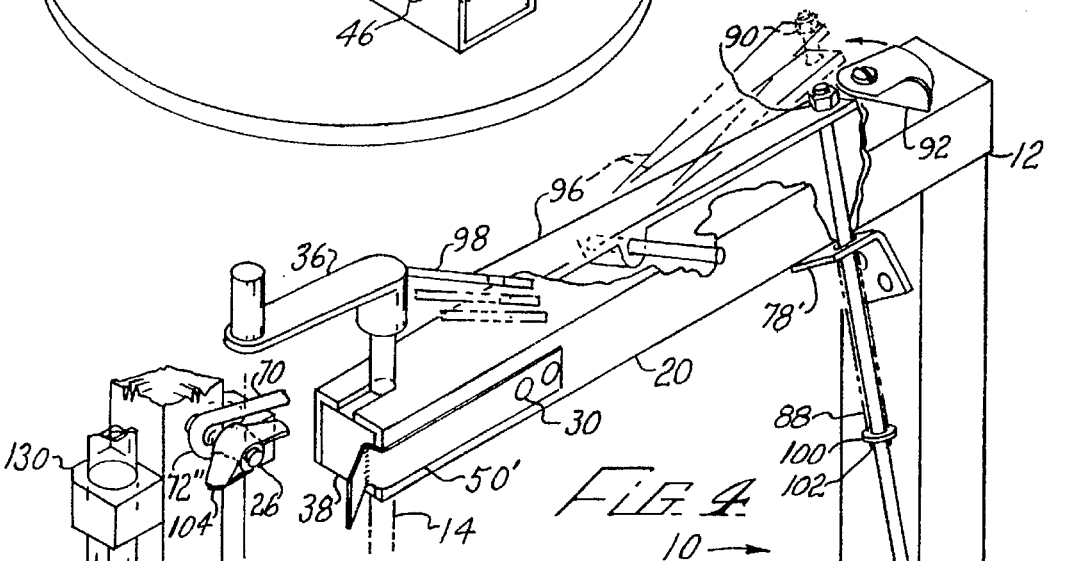
FIG. 4
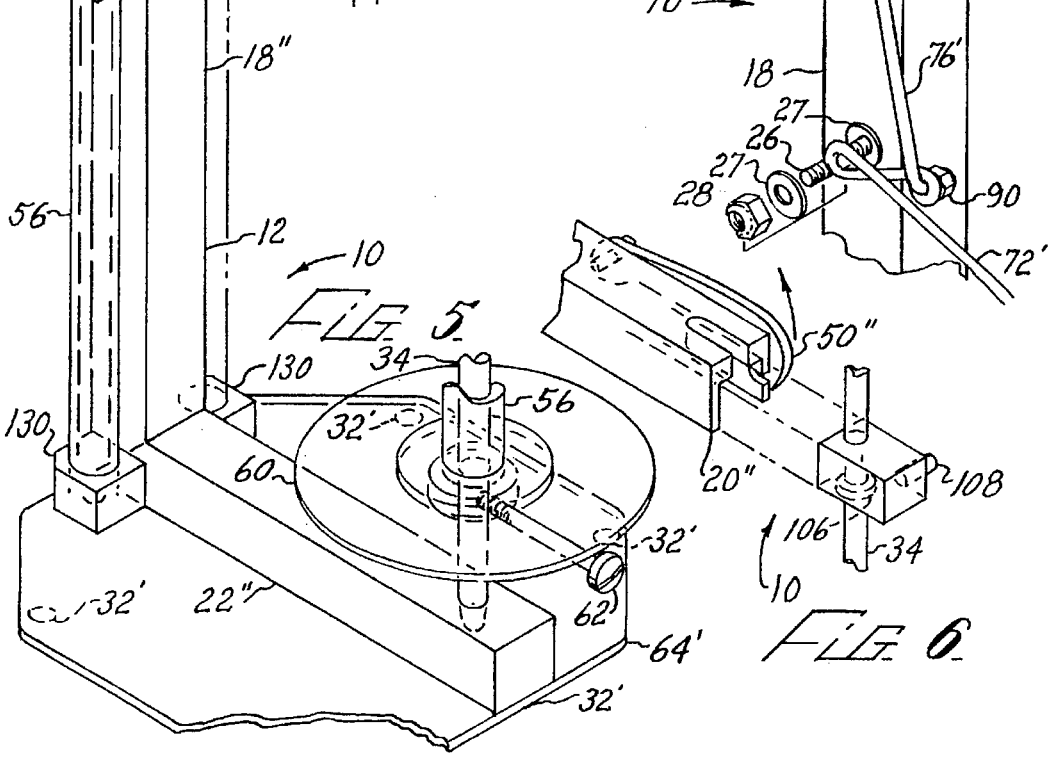
FIG. 5
FIG. 6

APPARATUS AND METHOD FOR SPOOLING STRANDED MATERIAL

DISCLOSURE DOCUMENT

This application relates to Disclosure Document No. 346,799 that was filed on Jan. 27, 1994.

BACKGROUND

The present invention relates to crafts such as knitting and crocheting, and more particularly to devices and methods for managing supplies of yarn or thread being used in manual stitching of stranded material.

Holders for crochet thread are disclosed, for example, in U.S. Pat. Nos. 1,174,637 to Stupfell, 1,290,577 to Kinney, and 1,505,623 to Burton. Similar devices for yarn are disclosed, for example, in U.S. Pat. Nos. 1,278,528 to Van Rensselaer, 2,536,931 to Harwood, 4,634,077 to Wilson, and 4,955,557 to Sewell et al. Typically, a post or spindle is vertically supported on a base for holding a spool or skein of stranded material, and a guide for the strand may be provided. The devices of the prior art have not been entirely satisfactory for a variety of reasons; for example:

1. Excessive and/or uneven force is required for feeding the strand;
2. Yarn in skeins is subject to damage by insertion of a sharply pointed spindle therethrough in that the spindle can split strands of the yarn, a further consequence being that feeding of the strand beyond a point of separation is blocked by the spindle;
3. The devices are ineffective for feeding complete skeins, even in the absence of damage from inserting the spindle, because there is little chance of inserting the spindle exactly through the center of a skein.

A further problem is that the holders of the prior art are inconvenient to use for winding the strand such as for restoring to the spool or skein played-out lengths of the strand that are not being immediately used.

Thus there is a need for a strand holding apparatus that provides for both cones and skeins uniformly low feeding resistance, being effective for dispensing complete skeins without damage thereto, that is easy to use for winding as well as feeding the strand, and that is inexpensive to produce.

SUMMARY

The present invention meets this need. In one aspect of the invention, apparatus for managing a supply of wound stranded media to be hand-worked into a workpiece includes a base for support on a horizontal supporting surface; a spindle shaft supportable relative to the base on a spindle axis, a first flange supported by the spindle shaft and rotatable about the spindle axis for supporting the supply of media being played out to the workpiece; a guide member supported to one side of the spindle axis for guiding the media between the supply and the workpiece, the guide member being manually movable between first and second positions during rotation of the spindle shaft for axially dispersing the media being rewound onto the supply between opposite ends thereof; and means for holding the guide member in a third position that is spaced between the first and second positions for permitting the media to be played out through the guide from the supply with axial displacements of the media between the supply and the guide being limited to approximately half of an axial length of the supply. The apparatus can further include a hand crank operatively connected to the first flange for rotation thereof to rewind selected portions of the stranded media onto the supply, the guide member being operable between the first and second positions during operation of the hand crank.

Preferably the apparatus has stationary structure near the hand crank, and a control member coupled to the guide member for movement thereof in response to downward finger pressure proximate the stationary structure for facilitating the rewinding by one using one hand turning the crank and the other hand holding the apparatus and moving the control member, the guide member being biased toward the first position thereof. The means for holding the guide member can include a stop member movably mounted relative to the stationary structure for selectively preventing upward movement of the control member.

The apparatus can further incorporate a frame supported on the base and having a first spindle bearing laterally spaced from an upstanding column member, and an arm member projecting from the top of the column member and having latch means for releasably holding a second spindle bearing vertically spaced from the first spindle bearing; and a spindle unit including the spindle shaft, the first flange, the hand crank, and the second spindle bearing, the first flange being removably fixably mounted to the spindle shaft, the hand crank being fixably mounted proximate one end of the spindle shaft, the opposite end of the spindle shaft being adapted for rotatably engaging the first spindle bearing, the second spindle bearing being rotatably mounted to the spindle shaft between the first flange and the hand crank. When the second spindle bearing is being held by the latch means with the opposite end of the shaft engaging the first spindle bearing, the spindle axis is vertically oriented with the spindle shaft and the first flange freely rotatable by the hand crank.

The guide member can form an open eyelet near one end of a guide arm pivotally mounted to the column member approximately midway between the spindle bearings. Preferably the means for holding the guide member includes a guide clamp for selectively clamping the guide arm in the third position of the guide member.

A control rod can be movably connected between the frame and the guide arm, having a control knob operatively coupled thereto for moving the guide arm from the first position to the second position of the guide member in response to unidirectional finger pressure; and a stop member movably mounted relative to the frame and having a first position for preventing movement of the control rod from the third position of the guide member toward the first position, the guide arm being biased toward the first position. Preferably the control knob is located proximate the arm member of the frame for facilitating simultaneous operation of the crank with respective hands of a user spaced no farther than a distance between the crank and the column member, the guide member being moved toward the second position in response to downward pressure on the control knob. The control knob can be affixed to an end extremity of the control rod. The stop member can selectively engage the control knob. The apparatus can further include a lever pivotally connected to the arm member and coupled to the control rod for actuation thereof, the control knob being located on the lever near the crank.

The apparatus can further include a tubular temporary core removably connected to the first flange, and a guide pin having a coupling for axially connecting the temporary core in flush relation to one end of the guide pin when the temporary core is removed from the first flange, the other end of the guide pin having a smoothly blunt tapered end profile for piercing a skein or ball of the media without damage to the stranded media.

In another preferred configuration, a first end of the spindle shaft has a conical journal extremity formed thereon, an opposite second end of the spindle shaft having a smoothly blunt tapered end profile, the apparatus further including the frame fixably connected to the base, the first spindle bearing being fixably supported relative to the base for engaging the journal extremity of the spindle shaft, the second spindle bearing being located on the frame for engaging the tapered end profile of the spindle shaft whereby the spindle shaft is rotatable on a spindle axis extending between the first and second spindle bearings, the frame being temporarily elastically deformable for receiving the spindle shaft between the first and second spindle bearings.

The frame can include a C-shaped bar of substantially uniform cross-section, including a column portion laterally spaced from the spindle axis, a leg portion projecting near one extremity of the column portion for supporting the first spindle bearing, and an arm portion projecting near an opposite extremity of the column portion for supporting the second spindle bearing, the base being connected to the leg portion, the combination of the base and the frame having orthogonal first and second orientations supported on the supporting surface, the spindle axis being vertical in the first orientation for permitting free rotation of the spindle shaft supported by the conical extremity of the journal, the spindle axis being horizontal in the second orientation for facilitating rewinding of the selected portions of the stranded media. Preferably the apparatus can further include a floating flange slidably engagable with the spindle shaft for locating contact with an inside surface of a cone core having the stranded media thereon when the cone core is inverted on the first flange with the spindle shaft vertically oriented.

In another aspect of the invention, the supply is wound on a cone core having an inside conical surface with a major inside diameter greater than 1.5 inches and a minor inside diameter less than 1 inch, the apparatus including the base; the spindle shaft supported relative to the base on a vertical spindle axis, a first flange supported by the spindle shaft and rotatable about the spindle axis for supporting the supply of media being played out to the workpiece, the first flange having a face diameter D being between approximately 1 inch and approximately 1.5 inches for engaging the inside conical surface of the cone core; the guide member fixably supported above the base and to one side of the spindle shaft; and means for adjusting a spacing between the first flange and the base for locating the axial length of the supply approximately centered relative to the guide member. Preferably the apparatus further includes a second flange removably supported on the spindle shaft in spaced relation above the first flange for retaining the cone core.

DRAWINGS

These and other features, aspects, and advantages of the present invention will become better understood with reference to the following description, appended claims, and accompanying drawings, where:

FIG. 2 is a left-oblique elevational perspective view showing an alternative configuration of a lower portion of the apparatus of FIG. 1;

FIG. 3 is a fragmentary sectional elevational view a showing an alternative configuration of an upper portion of the apparatus of FIG. 1;

FIG. 4 is a right-oblique elevational view showing another alternative configuration an upper portion of the apparatus of FIG. 1;

FIG. 5 is a perspective view as in FIG. 2, showing another alternative configuration of the apparatus of FIG. 1;

FIG. 6 is a left-oblique perspective elevational view showing an upper portion of the apparatus of FIG. 5;

DESCRIPTION

Figure 1:
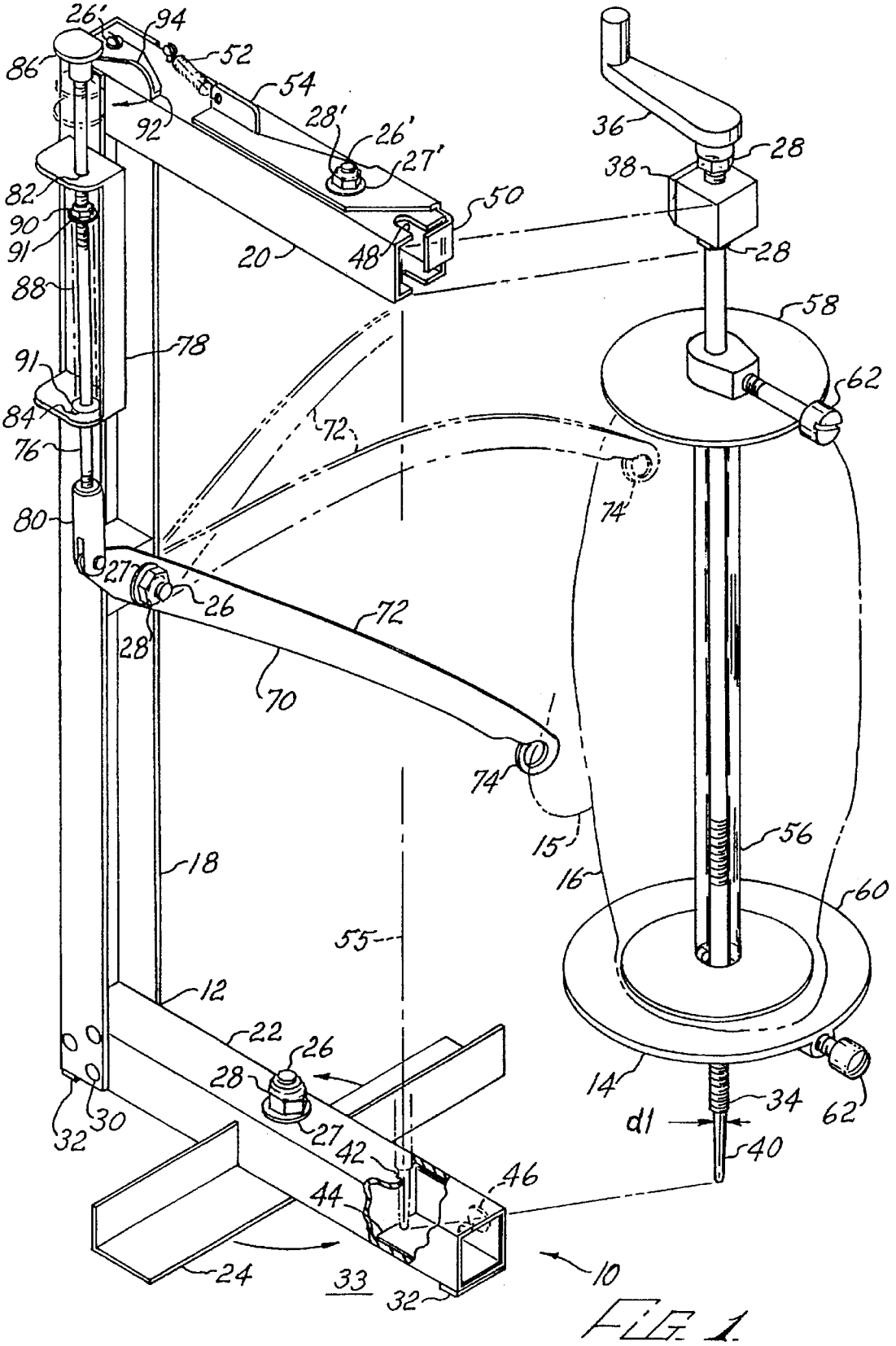
FIG. 1 is a partially exploded left-oblique elevational perspective view of a strand dispensing apparatus according to the present invention.

The present invention is directed to a system that facilitates hand-advancing of strands such as yarn and crochet thread at low tension from spools and/or skeins thereof. With reference to FIG. 1 of the drawings, a spindle apparatus 10 has a frame 12 and a spindle unit 14 that is adapted for mounting a cone, ball or skein of stranded material media 15 such as yarn or crochet thread as described below, a skein 16 being illustrated in FIG. 1. The frame 12 includes a column portion 18, an arm portion 20 and a leg portion 22 projecting horizontally from respective upper and lower extremities of the column portion 18, and a base member 24 pivotally connected to the foot portion 22 for movement between a deployed position perpendicular to the leg portion 22 as shown in FIG. 1, and a storage position folded alongside the leg portion 22 as indicated by the counterclockwise arrows in FIG. 1. In the exemplary configuration of FIG. 1, pivotal connection of the base member 24 is by a flat-headed screw fastener 26, and washer 27 and lock nut 28; and the frame 12 is of metal construction, the column portion 18 having a uniform C-shaped cross-section, and the arm and leg portions 20 and 22 having uniform square cross-section, suitable materials therefor being extruded aluminum. For example, the column portion 18 can be made from extruded channel ⅞ inch wide by ½ inch flange width by 1/16 inch wall thickness, approximately 13.25 inches long; the arm and leg portions 20 and 22 being made from ¾ inch square tubing having 1/16 inch wall thickness, the arm portion 20 having a length of approximately 5 inches, the leg portion 22 having a length of approximately 6 inches. The arm and leg portions 20 and 22 are rigidly connected to the column portion by respective pluralities of rivets 30. Suitable spacers (not shown) can be used within the square tubing of the arm and leg portions 20 and 22 for facilitating installation of the rivets 30. The base member 24 may be formed by removing diagonally opposing flange portions from a length of extruded aluminum channel having a cross-sectional shape corresponding to the column portion 18. A pair of foot members 32 project downwardly from opposite ends of the leg portion 22, approximately flush with the bottom of the base member 24, the combination of the base member 24 and the foot members 32 providing stable support of the frame 12 on a flat supporting surface 33 such as a table top in the extended position of the base member 24. The foot members 32 are affixed by a suitable adhesive, being preferably formed of a resilient polymer having a high frictional coefficient for securely anchoring the frame 12 against the low tension forces required for advancing the yarn or thread strands, suitable feet being commercially available from a variety of sources.

The spindle unit 14 includes a spindle shaft 34 having an outside spindle diameter d, a crank 36 rigidly extending from an upper extremity of the shaft 34, and an upper bearing 38 for rotatably supporting the shaft 34 proximate the crank 36, the bearing 38 being removably supported proximate a free extremity of the arm portion 20 of the frame 12 as described below. A lower extremity of the shaft 34 is formed having a journal portion 40 for rotatably engaging the leg portion 22 of the frame 12, the shaft 34 extending vertically in parallel-spaced relation to the column portion 18. More particularly, the journal portion 40 is formed with a reduced locating diameter d1 for freely engaging a spindle opening 42 that is formed in an upper wall of the leg portion 22, a bottom extremity of the journal portion 40 being smoothly rounded for low-friction axial engagement against a horizontally disposed surface of a thrust bearing 44, the bearing 44 being affixed upon a bottom wall of the leg portion 22. As shown in FIG. 1, the thrust bearing 44 is formed of thin sheet angle having a smooth hard surface, being held in place within the leg portion 22 by a screw fastener 46 that extends through a side wall of the leg portion 22. A suitable material for the thrust bearing 44 is "half-hard" stainless steel sheet.

The arm portion 20 of the frame 12 has a spindle slot 48 formed through upper and lower walls thereof for receiving the portions of the spindle shaft 34 as the upper bearing 38 enters the arm portion 20 of the frame 12. The upper bearing 38 is removably retained approximately flush with the free end of arm portion 20 by a latch 50 that is pivotally mounted to the arm portion 20 by a screw fastener 26', washer 27' and a lock nut 28', being reduced in size from the fastener 26, washer 27, and nut 28, the faster 26' also having a conventional shouldered head. The latch 50 is biasingly held in a closed position as shown in FIG. 1 by a latch spring 52, the latch 50 having an upwardly extending finger tab 54 for moving same to an open position when it is desired to remove or replace the upper bearing 38. Thus the spindle unit 14 is freely rotatable on a spindle axis 55 in the frame 12 with low-friction bearing support proximate opposite ends thereof, being quickly removable and replaceable without tools for loading or changing the media 15. The widely spaced combination of the upper bearing 38 with the spindle opening 42 and thrust bearing 44 generously stabilizes the spindle shaft 34, particularly when the crank 36 is being used for winding the media 15 onto the spindle unit 14 as described below. Further, the arm portion 20 (and to a lesser extend an upper region of the column portion 18) provides stationary structure of the apparatus 10 that facilitates cranking of the crank 36 with one hand while holding the hereby stationary structure with the other hand. A suitable material for the spindle shaft 34 is #10–24 threaded steel rod.

In the exemplary configuration of FIG. 1, the crank 36 threadingly engages the spindle shaft 34, being secured thereto by another counterpart of the lock nut 28. An additional counterpart of the lock nut 28 is located below the upper bearing 38 for retaining same approximately vertically positioned on the spindle shaft 34 for entry into the arm portion 20, which entry is further facilitated by the upper bearing 38 being tapered toward the column portion 18. Suitable materials for the upper bearing 38 include Nylon®, Delrin®, and acrylics.

As indicated above, the present invention provides convenient and relatively rapid winding of the media 15 onto the spindle unit 14, such being desired in one or more of the following situations:

1. When consumption of the media such as by knitting or crocheting is being suspended, for convenient storage of the apparatus 10 together with the media 15;
2. In case of inadvertent feeding of excess lengths of the media such as when mistakes are made in the hand work and stitches must be pulled out, for restoring the excess length to the spindle unit 14; and
3. When the skein 16 is nearly expended, a remainder of the media 15 being sufficiently off-center on the spindle unit 14 that continued consumption in that condition is no longer practical, for freshly winding the remainder onto the spindle unit 14 for consumption thereof.

The spindle unit 14 further includes a temporary core 56, an upper flange 58, and a lower flange 60, the flanges 58 and 60 being provided with respective clamp screws 62 whereby the core 56 and the flanges 58 and 60 are removably clamped onto the spindle shaft 34. As described further below in connection with FIG. 8, the temporary core 56 can be loaded with the skein 16 without damage to the media 15. Alternatively, and preferably with the temporary core 56 being unused, the spindle unit 14 can be loaded with a spool or cone core having the media 15 as described below in connection with FIG. 7. In the configuration of FIG. 1, the temporary core 56 rotates with the spindle shaft 34 for being driven by the crank 36. Torque transmittal to the core 56 sufficient for winding the media 15 onto the spindle unit 14 is obtained by frictional contact with one or both of the flanges 58 and 60, such as by clamping the flanges to the shaft 34 with some axial pressure applied to the core 56, and/or by a very slight interference fit between one or both of the flanges 58 and 60 and an outside diameter of the core 56.

An important feature of the present invention is a strand guide 70 that has stationary and movable modes of operation as described herein. The guide 70 includes a guide arm 72 that is pivotally connected to the frame 12 and having a slotted eyelet 74 at a free extremity thereof for passing the media 15, means for holding the guide arm 72 with the eyelet 74 approximately vertically centered to one side of the skein 16 (or other supply of the media 15, as indicated by double-dashed lines in FIG. 1), and means for raising and lowering the eyelet 74 on either side of the centered position thereof during operation of the crank 36 (between a lowered position as shown by solid lines, and a raised position as indicated by triple dashed lines in FIG. 1) for approximately level winding of the media 15 onto the spindle unit 14. In the exemplary configuration of FIG. 1, the guide arm 72 is pivotally mounted to the column portion 18 using counterparts of the screw fastener 26, the washer 27, the lock nut 28, and the upper bearing 38. The raising and lowering of the eyelet 74 is effected by a control rod 76 that is slidably supported relative to the frame 12 by a bracket 78, the bracket 78 being affixed to the column portion 18 by counterparts of the rivets 30. The control rod 76 is pivotally connected to the guide arm 72 by a clevis 80, the clevis 80 being located opposite the eyelet 74 at a relatively short distance from the fastener 26 for effecting a wide range of motion of the eyelet 74 in a relatively short stroke of the control rod 76. The rod 76 is guided by an upper flange opening 82 of the bracket 78, the rod 76 also passing through a lower flange opening 84 of the bracket 78, the opening 84 being elongated for accommodating slight lateral motion of the rod 76 resulting from angular movement of the guide arm 72. A control knob 86 is attached to an upper extremity of the rod 76, whereby the eyelet 74 is raised by depressing the control knob 86. The control rod 76 extends through a helical guide spring 88, a lock nut 90 being threaded onto the rod 76 for biasingly coupling the rod 76 by the spring 88 to the bracket 78 for enhancing downward movement of the eyelet 74 as the control knob 86 is being released. As further shown in FIG. 1, a pair of washers 91 is disposed on opposite ends of the spring 88.

The stationary mode wherein the eyelet 74 is maintained approximately centered relative to the supply of media 15 is effected by a stop arm 92 that is pivotally mounted to the frame 12 for selectively blocking a portion of the upward movement of the control knob 86 to a position corresponding to a centered position of the eyelet 74. The stop arm 92, being mounted to the arm portion 20 of the frame 12 by counterparts of the threaded fastener 26 and the lock nut 28', has a thumb tab portion 94 for manually swinging the arm 92 over the control knob 86 when the knob 86 is depressed sufficiently to clear the arm 92. A suitable material for the guide arm 72 is aluminum bar having a thickness of 3/32 inch, a width of 0.5 inch, and a length of approximately 6 inches, the eyelet 74 being formed as an open spiral for laterally receiving a strand of the media, the bar being further formed with a smooth curvature between the eyelet 74 and the fastener 26 for smooth passage of the media 15 from the spindle 14, through the eyelet 74, thence to a workpiece being formed thereby.

In use, the stop arm 92 is normally positioned over the control knob 86 as indicated by the clockwise arrow in FIG. 1 for effecting the stationary mode of the eyelet 74 when the media 15 is being fed from the spindle 14. When only a short length of the media 15 is to be rewound onto the spindle 24, the stationary mode can be continued, the winding being effected by manual operation of the crank 36 as described above. Alternatively, and preferably when longer lengths of the media 15 are to be wound onto the spindle 14, the stop arm is moved onto the arm portion 20 of the frame 12 as shown by solid lines in FIG. 1 for clearing the control knob 86, the knob 86 being cyclically depressed during the winding for producing an approximately level wind of the media 15 as desired.

With further reference to FIGS. 2 and 3, an alternative configuration of the apparatus 10 has the extruded materials of the frame 12 exchanged between the column portion, designated 18', and the arm and leg portions, respectively designated 20' and 22'. More particularly, the column portion 18' is tubular, having a square cross-section, and the arm and leg portions 20' and 22' being C-shaped in cross-section. In the configuration of FIGS. 2 and 3, as well as that of FIG. 1, the members are in a closely fitting overlapping condition for facilitating rigid connection thereof by the rivets 30 as described above. As shown in FIG. 2, a disk-shaped base member 64 is substituted for the base member 24 of FIG. 1. Also, a counterpart of the spindle opening 42 is provided by a counterpart of the upper bearing 38, the bearing 38 being fastened between flanges of the leg portion 22' by a counterpart of the screw fastener 46. As shown in FIG. 3, another counterpart of the upper bearing 38 is supported between flanges of the arm portion 20' by a retainer bracket 66, the bracket 66 being fastened in place by a counterpart of the rivet 30. A single counterpart of the spindle slot 48 is formed in a web section of the arm portion 20'. Further, a threaded boss 68 is crimped in place under the arm portion 20' for receiving a counterpart of the fastener 26 by which the latch 50 is pivotally mounted to the frame 12 for releasably locking the upper bearing 38 in place.

With further reference to FIG. 4, another alternative configuration of the apparatus 10 has a counterpart of the guide arm, designated 72' formed of wire, a counterpart of the control rod, designated 76', being pivotally connected directly to the guide arm 72' between the fastener 26 and the eyelet 74. Thus the eyelet 74 is raised by raising the control rod 76'. Also, a control lever 96 is pivotally mounted to the arm portion 20 of the frame 12 for actuation of the control rod 76', the lever 96 having an upwardly inclined thumb tab 98 for manual actuation proximate the crank 36. A counterpart of the bracket, designated 78', guides the control rod 76', the guide spring 88 being coupled to the rod 76' by a washer 100 that is located by an enlargement 102 of the rod 76'. In this configuration of the apparatus 10, the winding of the media 15 onto the spindle 14 is further facilitated by a user thereof being able to conveniently cycle the guide arm 72 while grasping the frame 12 proximate the crank 36, thereby making it easier to hold the apparatus in a desired position while operating the crank 36. As also shown in FIG. 4, the control rod 76' is coupled to the guide arm 72' and the control lever 96 by counterparts of the lock nut 90, and a counterpart of the stop arm 92 can selectively engage either or both of the rod 76' and the control lever 96 for effecting the stationary mode, holding the eyelet 74 approximately centered to one side of the supply of media 15. Further, a counterpart of the latch 50, designated 50', is formed as a deflectable spring member for accepting and releasably holding the upper bearing 38 of the spindle unit 14 seated in the frame 12.

With further reference to FIGS. 5 and 6, another configuration of the apparatus 10 has the frame 12 formed with counterparts of the column portion 18, the arm portion 20, and the leg portion, respectively designated 18", 20", and 22", made from a plastic material such as an acrylic polymer, the portions 18", 20" and 22" being mitered and rigidly joined by a suitable solvent cement. In the configuration of FIGS. 5 and 6, a counterpart of the base member, designated 64', is octagonal, a suitable material therefor also being acrylic plastic. Preferably the base member 64' is provided with a spaced plurality of resilient counterparts of the foot members, designated 32'.

As further shown in FIG. 5, an alternative configuration of the strand guide 70 incorporates a wing nut 104 in place of the lock nut 28 for selectively holding a counterpart of the guide arm, designated 72", in the centered position of the stationary mode. In this configuration, the control rod 76 and associated parts are omitted. Instead, the level winding of the media 15 onto the spindle 14 is effected by manual movement of the arm 72" using direct finger pressure thereon after loosening the wing nut 104. As shown in FIG. 5, the guide arm 72" is a formed wire member similar to the arm 72' of FIG. 4, but does not include a loop for connecting the control rod 76'. A suitable material for the arm 72" is thermo-plastic rod material that is available from a variety of sources. Characteristic of the apparatus 10 as configured in FIGS. 5 and 6 is that substantially all of the parts thereof can be provided in non-metallic materials. For example, the screw 26 and the wing nut 104 can be formed of Nylon®. The spindle shaft 34 can also be formed of a suitable plastic such as acrylic, counterparts of the spindle opening 42 and the thrust bearing 44 being formed integrally with the leg portion 22' by molding or drilling. In the configuration of FIGS. 5 and 6, the spindle shaft 34 is provided with a ring member 106 under the upper bearing 38 in place of the lock nut 28 of FIG. 1, the ring member 106 also being formed of acrylic and affixed by a suitable adhesive. Also, a counterpart of the latch, designated 50", is pivotally mounted against one side of the arm portion 20" for selectively engaging a lug 108 that rigidly protrudes from a counterpart of the upper bearing 38, whereby the bearing 38 is removably secured in the frame 12 as described above. Further, a counterpart of the crank 36, also formed of acrylic, can be cemented directly to an upper extremity of the spindle shaft 34 as shown in FIG. 7, discussed below.

Figure 7:
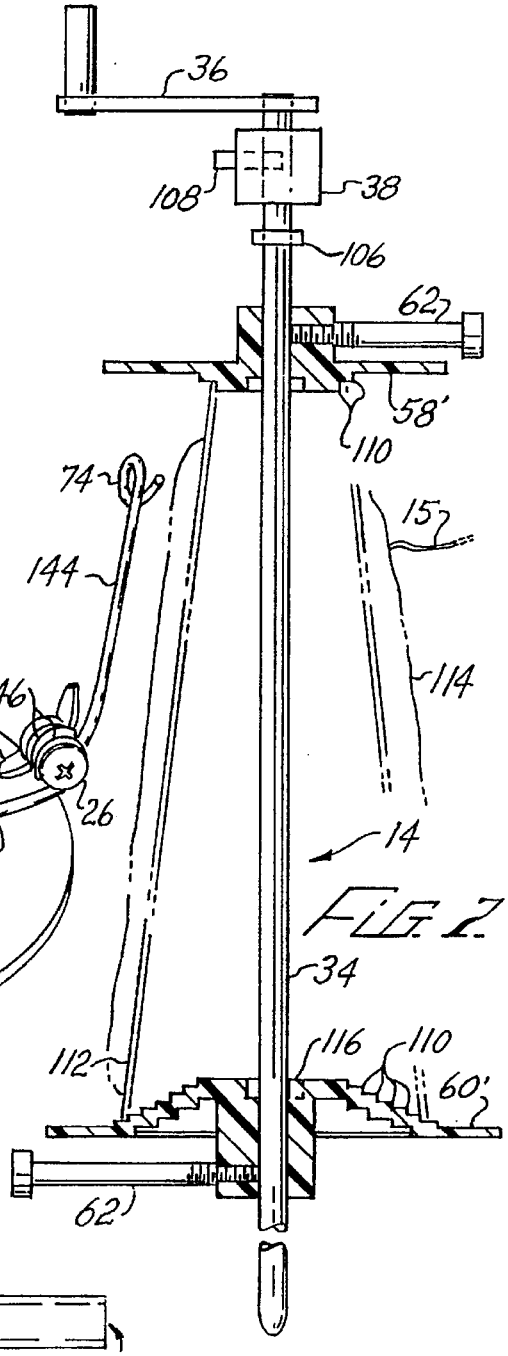
FIG. 7 is a fragmentary sectional elevational view of a spindle portion of the apparatus of FIG. 5.

With further reference to FIG. 7, the spindle unit 14 in the configuration of FIGS. 5 and 6 can have counterparts of one or both of the upper and lower flanges, designated 58' and 60', formed with a series of concentric steps 110 for locating engagement with a variety of cone cores such as the core 112 which can carry a supply of crochet thread as the media 15, the combination with the core 112 being designated spool 114. As also shown in FIG. 7, the lower flange 60' has an indexing dog 116 formed therein for rotationally locking a counterpart of the temporary core 56 thereto as described below for insuring direct drive thereof when the crank 36 is operated, without requiring a tight fit between the core 56 and either the spindle shaft 34 or one of the flanges 58 and 60.

Figure 8:
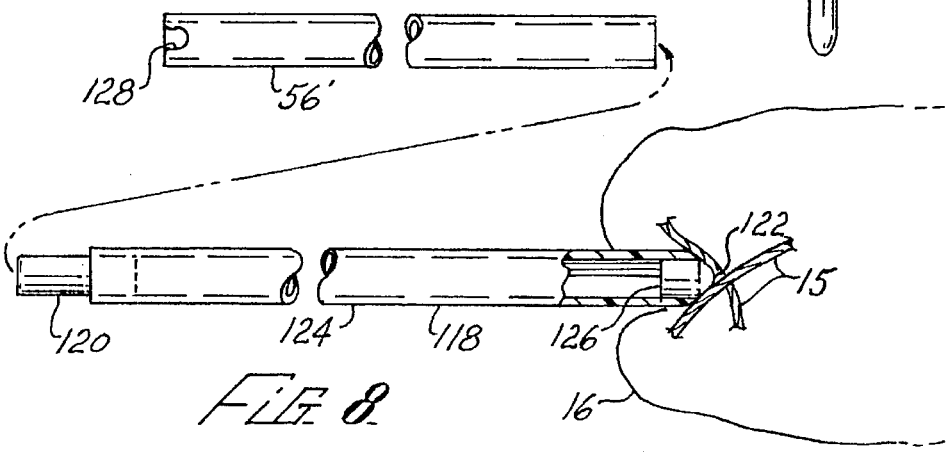
FIG. 8 is a fragmentary sectional view showing a skein being loaded onto a temporary core of the apparatus of FIG. 1.

FIG. 8 shows a counterpart of the temporary core, designated 56', being loaded with the skein 16 of the media 15, using a guide pin 118 for avoiding damage to the media 15 of the skein 16. The guide pin 118 is formed with an outside diameter corresponding to the temporary core 56 (or 56'), one end thereof having a coupling member 120 for concentric engagement with an inside diameter of the temporary core 56, the other end having a bluntly rounded nose configuration as indicated at 122. In exemplary implementations of the apparatus 10, the temporary core 56 can be made from a length of acrylic tubing having an outside diameter of approximately 0.5 inch, an inside diameter of 0.25 inch, and a length of approximately 10 inches. The guide pin 118 can be fabricated with a tubular body portion 124 being a duplicate length of the acrylic tubing of the core 56, the coupling member 120 being a short length of 0.25 inch diameter acrylic rod cemented to the inside diameter of the body portion 124 and extending therefrom. A nose member 126, being a shorter length of the acrylic rod, is cemented to the body portion 124 opposite the coupling member 120, the body portion 124 being smoothly shaped together with the nose member 126 with the bluntly rounded and tapered profile 122.

As indicated in FIG. 8, the tapered profile 122 of the guide pin 118 is worked gently through the skein 16, approximately concentric therewith, until the body portion 124 projects from opposite ends of the skein 16. Next, the guide pin 118 is axially joined with the temporary core 56 and the skein 16 is slipped from the guide pin 118 and onto the core 56. Then, the core 56 is assembled into the spindle unit 14 and the spindle unit 14 is mounted into the frame 12, whereby the supply of media 15 is loaded into the apparatus 10. As shown in FIG. 8, the temporary core 56' has a notch 128 formed at one end thereof for engaging the indexing dog 116, whereby the temporary core 56' is positively driven in unison with the lower flange 60' by the crank 36.

Respective vertically spaced pairs of holder blocks 130 are provided on the frame 12 in the configuration of FIGS. 5 and 6 for convenient storage of the temporary core 56 and the guide pin 118. The holder blocks 130, which can be formed from pieces of the same acrylic material as the frame portions 18", 20" and 22", are affixed to opposite sides of the column portion 18" of the frame 12 by a suitable cement.

Figure 9:
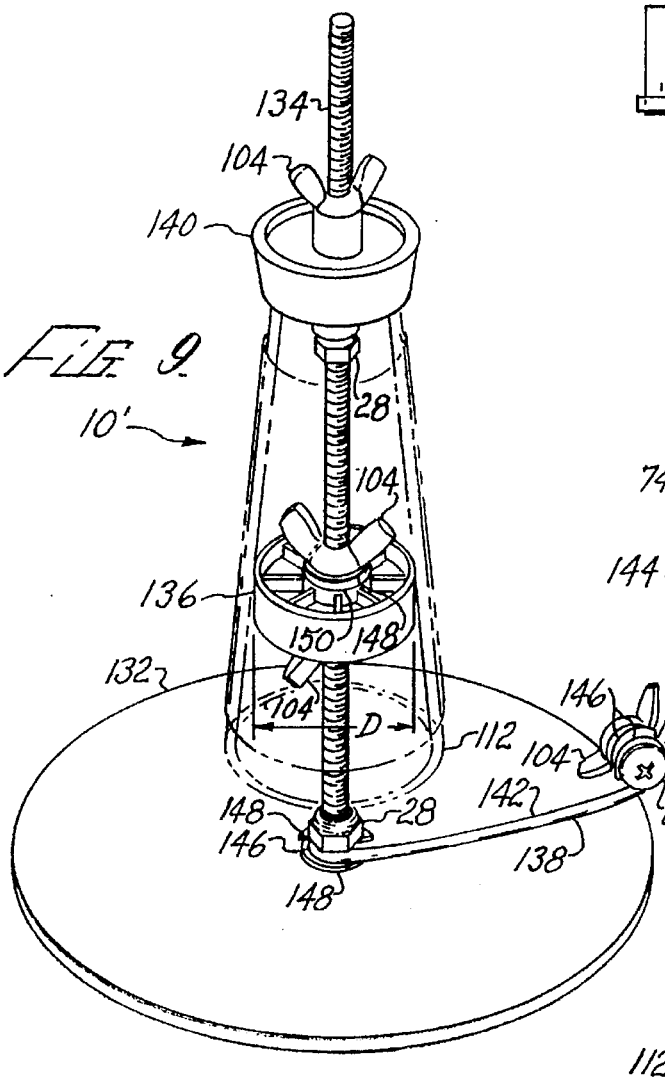
FIG. 9 is a left-oblique elevational perspective view showing a further alternative configuration of the apparatus of FIG. 1.

With further reference to FIG. 9, yet another alternative configuration of the apparatus, designated 10', is adapted particularly for dispensing the media 15 from counterparts of the cone core 112. The apparatus 10' includes a disk-shaped base 132, an upstanding post 134 approximately centrally located on the base 132, a main roller 136 being freely rotatable on the post 134 and vertically adjustable as further described below, and a strand guide unit 138 extending outwardly and upwardly from proximate a lower extremity of the post 134. Preferably a retainer roller 140 is adjustably locatable on the post 134 above the main roller 136 for retaining the core 112 seated on the main roller 136.

More particularly, an exemplary configuration of the apparatus 10' has the post 134 being a length of threaded rod, threadingly engaging the base 132. The guide unit 138 includes respective first and second arm segments 142 and 144, the second arm segment having a counterpart of the eyelet 74 at a free extremity thereof. The arm segments 142 and 144 are formed of solid wire material, one end of the first arm segment having a loop 146 formed therein for enclosing the post 134, being clamped between a pair of washers 148 against the base 132 by a counterpart of the lock nut 28. Adjacent ends of the arm segments 142 and 144 have counterparts of the loop 146, being pivotally connected by counterparts of the screw fastener 26 and the wing nut 104. Thus the eyelet 74 is adjustably locatable relative to the base 132 and the post 134, the wing nut 104 providing means for holding the eyelet 74 selectively fixed in a desired position.

The main roller 136 can be cylindrical annulus in form, a pair of flanged bushings 150 being inserted at opposite ends thereof for obtaining a close free-rolling fit with the post 134. The bushings 150 are axially retained at a desired elevation on the post 132 by an opposed pair of the wing nuts 104 and washers 148, the roller 136 supporting the core 112 against a tapered inside wall surface thereof. It has been discovered that the main roller 136 having an outside diameter D of approximately 1.33 inches provides stable and concentric support for a wide variety of cone cores commonly in use as spools for crochet thread. This is because the roller 136 engages typical ones of the cores 112 vertically near a center of gravity of the loaded spool 114, and because the outside surface of roller 136, being a right circular cylinder, seeks angular alignment with the cone core 110 loaded thereon.

The retainer roller 140 is supported by a counterpart of the lock nut 18 and retained thereon by a counterpart of the wing nut 104. The outside surface of the retainer roller 140 is frustro-conical in form, tapering downwardly and inwardly for engagement by upper extremities of larger ones of the cone cores 112, without in many cases requiring adjustment of the supporting lock nut 28. Smaller ones of the cone cores 112 are retained under lower side surfaces of the retainer roller as shown in FIG. 9. Normally, the cone core 112 need not contact the retainer roller 140 except in the event that the apparatus 10' is accidentally tipped over or inadvertent contact is made with the spool 114 (or when the apparatus 10' is stored or transported with the spool 114 loaded thereon).

Figure 12:
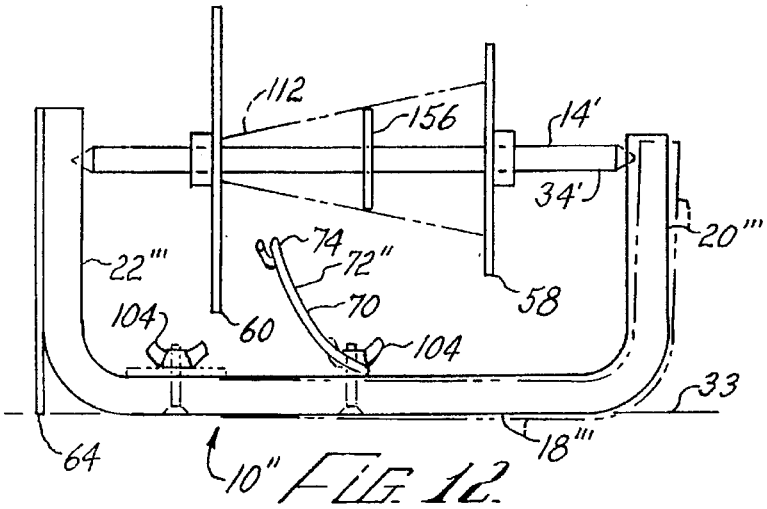
FIG. 12 is a side elevational view of the apparatus of FIG. 10, horizontally oriented.
Figure 10:
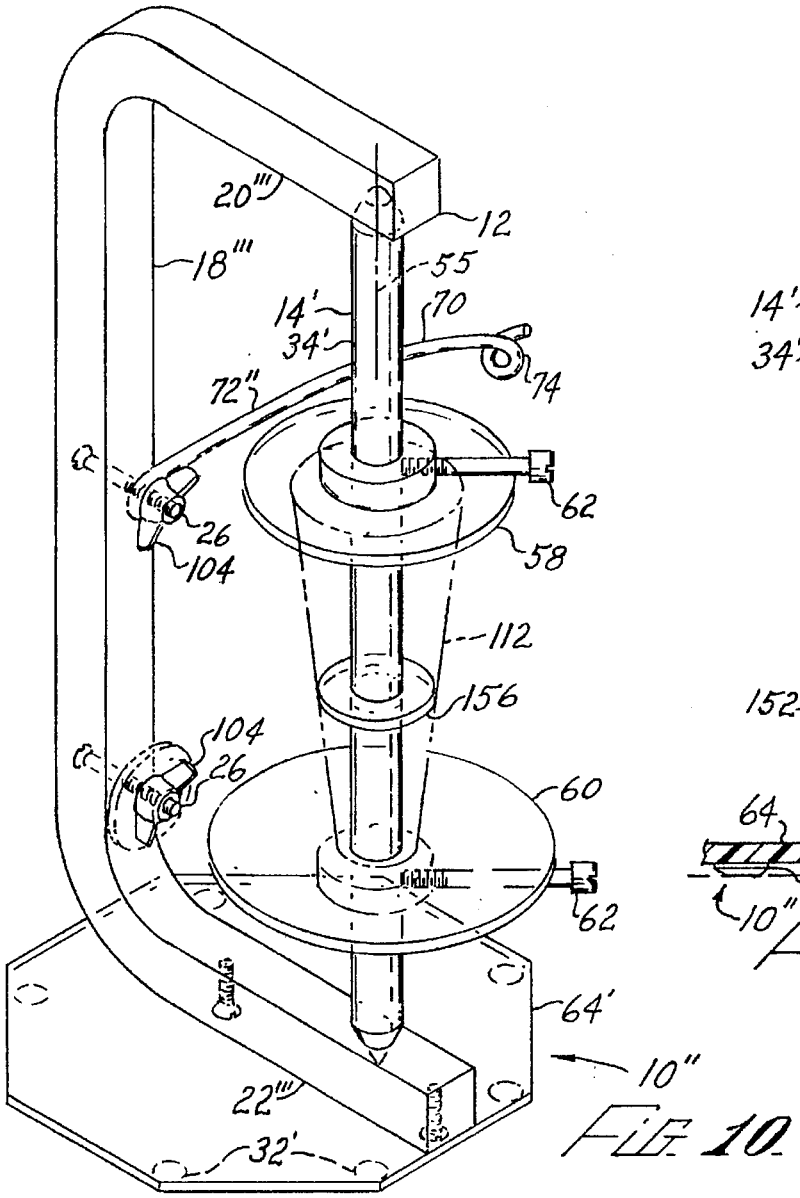
FIG. 10 is an oblique elevational perspective view showing an alternative configuration of the apparatus of FIG. 5, vertically oriented.
Figure 11:
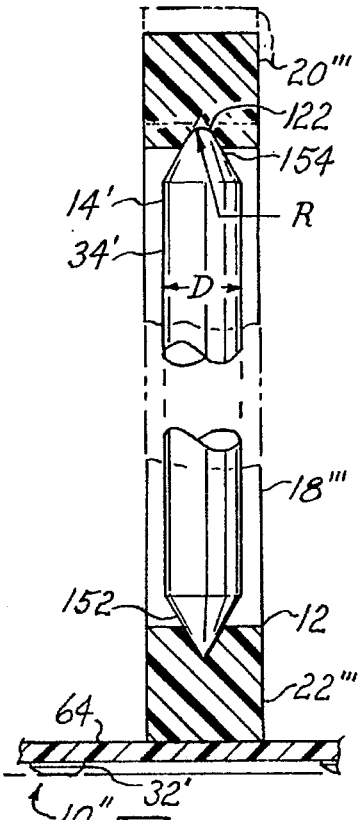
FIG. 11 is a fragmentary sectional elevational view of a portion of the apparatus of FIG. 10.

With further reference to FIGS. 10–12, yet another configuration of the apparatus, designated 10", has the column, arm, and leg portions of the frame 12, respectively designated 18'", 20'", and 22'", integrally formed of a material having a desired combination of stiffness and elasticity to permit the spindle to be installed and removed by the expedient of momentarily deflecting the frame to spread the arm and leg portions 20''' and 22'''. For this purpose, a suitable material for the frame member 12 is a solid bar of acrylic plastic, ¾ inch square, heat-formed in a C-shaped configuration. A counterpart of the spindle unit, designated 14', includes a counterpart of the spindle shaft, designated 34', that is formed of a solid round bar having a diameter D of approximately 0.5 inch, one end thereof having a conical journal 152, the other end having a counterpart of the nose profile 122 formed on a tapered journal 154.

A counterpart of the base 64' is fastened to the frame 12 such that one edge thereof is flush with the column portion 18''' for placement of the apparatus 10" with the spindle axis 55 vertically in a first orientation as described above, and in a second orientation horizontally with the base 64' and the column portion 18''' resting on the horizontal supporting surface 33. In the first orientation, the spindle unit 14' rotates with little or substantially no resistance for permitting the media 15 to be freely drawn from the skein 16 or the cone core 112. The horizontal orientation facilitates rewinding of the media 15, rotating the spindle 14' by directly rotating one of the flanges 58 or 60 while manipulating the guide 70 as desired for level winding.

As further shown in FIG. 10, the apparatus 10' further includes a floating flange 156 that slides freely on the spindle shaft 34' for locatingly contacting the inside conical surface of the cone core 122 when the core 122 is inverted on the second flange 60. Once located as thus described, the cone core 122 can be secured on the shaft 34' by the first flange 58. Counterparts of the fastener 26 and the wing nut 104 are provided on the column portion 18''' for holding the floating flange 156 when the flange 156 is not being used.

The apparatus 10 of the present invention provides a convenient, effective and economical way to manage stranded material media including yarn and crochet thread for hand use. It is versatile in that the media can be used directly from skeins, spools, and cones. It is effective in that there is very low resistance to feeding the media, and in the configurations of FIGS. 1–8 it is efficient in that the media can be quickly and easily rewound onto the spindle 14 by the crank 36, with level winding as desired. The configuration of FIG. 9 is particularly convenient, inexpensive and effective for feeding crochet thread on cone cores in a variety of sizes. The configuration of FIGS. 10 and 11 provides a desirable combination of convenience, effectiveness, versatility, low cost, and decorative appearance.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. Apparatus for managing stranded media to be handworked into a workpiece, the media being wound in a supply of the media, the supply having an axial length, the apparatus comprising:

(a) a base for support on a horizontal supporting surface;

(b) a spindle shaft supportable relative to the base on a spindle axis, a first flange supported by the spindle shaft and rotatable about the spindle axis for supporting the supply of media being played out to the workpiece;

(c) a guide member supported relative to the base and laterally displaced from the spindle axis for guiding the media between the supply and the workpiece, the guide member being manually movable between first and second positions that are laterally spaced from corresponding locations along the spindle axis for axially dispersing media being rewound onto the supply of media; and (d) means for holding the guide member in a third position, the third position being spaced intermediate the first and second positions for permitting the media to be played out through the guide from the supply with axial displacements of the media between the supply and the guide being limited to approximately half of the axial length of the supply.

2. The apparatus of claim 1, further comprising a hand crank operatively connected to the first flange for rotation thereof to rewind selected portions of the stranded media onto the supply, the manually movable guide member being operable between the first and second positions during operation of the hand crank.

3. The apparatus of claim 2, wherein the apparatus has stationary structure located near the hand crank, the apparatus further comprising means for biasing the guide member toward the first position thereof; and a control member coupled to the guide member for movement thereof in response to downward finger pressure proximate the stationary structure for facilitating the rewinding by one using one hand turning the crank and the other hand holding the apparatus and moving the control member.

4. The apparatus of claim 3, wherein the means for holding the guide member comprises a stop member movably mounted relative to the stationary structure for selectively preventing upward movement of the control member.

5. The apparatus of claim 2, further comprising:

(a) a frame supported on the base, a first spindle bearing fixably supported relative to the frame, an upstanding column member laterally spaced from the first spindle bearing, and an arm member projecting from proximate an upper extremity of the column member in spaced relation from the first spindle bearing and having latch means for releasably holding a second spindle bearing vertically spaced from the first spindle bearing; and (b) a spindle unit comprising the spindle shaft, the first flange, the hand crank, and the second spindle bearing, the first flange being removably fixably mounted to the spindle shaft, the hand crank being fixably mounted proximate one end of the spindle shaft, the opposite end of the spindle shaft being adapted for rotatably engaging the first spindle bearing, the second spindle bearing being rotatably mounted to the spindle shaft between the first flange and the hand crank, whereby, when the second spindle bearing is being held by the latch means with the opposite end of the shaft engaging the first spindle bearing, the spindle axis is vertically oriented with the spindle shaft and the first flange freely rotatable by the hand crank.

6. The apparatus of claim 5, wherein the guide member forms an open eyelet, the apparatus further comprising a guide arm pivotally mounted to the column member of the frame, laterally displaced from a point approximately midway between the first spindle bearing and the latch means for the second spindle bearing, the eyelet being located proximate a free end extremity of the guide arm.

7. The apparatus of claim 6, wherein the means for holding the guide member comprises a guide clamp for selectively clamping the guide arm in the third position of the guide member.

8. The apparatus of claim 6, further comprising:

(a) a control rod movably connected between the frame and the guide arm and having a control knob operatively coupled thereto for moving the guide arm from the first position to the second position of the guide member in response to unidirectional finger pressure;

(b) means for biasing the guide arm to the first position; and (c) a stop member movably mounted relative to the frame and having a first position for preventing movement of the control rod from the third position of the guide member toward the first position.

9. The apparatus of claim 8, wherein the control knob is located proximate the arm member of the frame for facilitating simultaneous operation of the crank with respective hands of a user spaced no farther than a distance between the crank and the column member, the guide member being moved toward the second position in response to downward pressure on the control knob.

10. The apparatus of claim 9, wherein the control knob is affixed to an end extremity of the control rod.

11. The apparatus of claim 10, wherein the stop member selectively engages the control knob.

12. The apparatus of claim 10, further comprising a lever pivotally connected to the arm member and coupled to the control rod for actuation thereof, the control knob being located on the lever proximate the crank.

13. The apparatus of claim 5, further comprising a tubular temporary core removably connected to the first flange, and a guide pin having a coupling for axially connecting the temporary core in flush relation to one end of the guide pin when the temporary core is removed from the first flange, the other end of the guide pin having a smoothly blunt tapered end profile for piercing a skein or ball of the media without damage to the stranded media.

14. The apparatus of claim 1, wherein a first end of the spindle shaft has a conical journal extremity formed thereon, an opposite second end of the spindle shaft having a smoothly blunt tapered end profile, the apparatus further comprising a frame fixably connected to the base, a first spindle bearing being fixably supported relative to the base for engaging the journal extremity of the spindle shaft, a second spindle bearing being located on the frame for engaging the tapered end profile of the spindle shaft whereby the spindle shaft is rotatable on a spindle axis extending between the first and second spindle bearings, the frame being elastically deformable for receiving the spindle shaft between the first and second spindle bearings.

15. The apparatus of claim 14, wherein the frame comprises a C-shaped bar of substantially uniform cross-section, including a column portion laterally spaced from the spindle axis, a leg portion projecting from proximate one extremity of the column portion for supporting the first spindle bearing, an arm portion projecting from proximate an opposite extremity of the column portion for supporting the second spindle bearing, the base being connected to the leg portion, the base and the frame being adapted for supporting the spindle with the spindle axis in orthogonal first and second orientations relative to the supporting surface, the spindle axis being vertical in the first orientation for permitting free rotation of the spindle shaft supported by the conical extremity of the journal, the spindle axis being horizontal in the second orientation for facilitating rewinding of the selected portions of the stranded media.

16. The apparatus of claim 14, further comprising a floating flange slidably engagable with the spindle shaft for locating contact with an inside surface of a cone core having the stranded media thereon when the spindle shaft is vertically oriented and the cone core is supported in an inverted orientation on the first flange.

17. Apparatus for managing stranded media to be hand-worked into a workpiece, the media being wound in a supply as a ball or skein of the media, the supply having an axial length, the apparatus comprising:

(a) a spindle unit comprising:

(i) a spindle shaft having a spindle axis, a conical journal formed on one extremity, and a smoothly blunt tapered end profile on an opposite extremity;

(ii) a first flange removably fixably mountable to the spindle shaft in a desired location between the conical journal and the tapered end profile of the spindle shaft; and (iii) a second flange adjustably mountable to the spindle shaft in a desired spaced relation to the first flange;

(b) a base including a rigidly connected C-shaped frame having a leg portion, an arm portion and an interconnecting column portion, spaced first and second spindle bearings fixably located relative to the leg and arm portions the frame for rotatably supporting the spindle unit on the spindle axis in spaced relation to the column portion, the base being formed for supporting the spindle axis in respective vertical and horizontal orientations relative to a horizontal supporting surface, the frame being elastically deflectable for receiving the spindle shaft;

(c) an arm pivotally connected to the base and having an open eyelet laterally displaced from the spindle axis for guiding the media between the supply and the workpiece, the eyelet being manually movable between first and second positions during manual rotation of the spindle unit for axially dispersing on the supply selected portions of the media being rewound thereon; and (d) a holder for holding the eyelet in a third position, the third position being spaced intermediate the first and second positions for permitting the media to be played out through the eyelet from the supply with axial displacements of the media between the supply and the eyelet being limited to approximately half of the axial length of the supply, whereby, when the base supports the spindle unit with the spindle axis vertically oriented, the spindle shaft is freely rotatable for facilitating the supply of media being played out to the workpiece through the eyelet, and (e) when the spindle shaft is removed from the spindle unit, the smoothly blunt end profile of the spindle shaft is effective for permitting the spindle shaft to be worked through the ball or skein of media without damage thereto, thereby facilitating loading of the media onto the temporary core.

18. A method for managing stranded material media, comprising the steps of:

(a) providing a spindle unit including a spindle shaft having a conical journal formed on one extremity and a smoothly blunt tapered end profile on an opposite extremity, and flanges mountable thereto in adjustably spaced relation;

(b) loading a supply of the stranded material onto the spindle unit with the flanges snugly against opposite ends thereof;

(c) providing a base including a C-shaped frame having a spaced pair of spindle bearings for supporting the spindle unit on a spindle axis with the conical journal making end contact with one of the spindle bearings, a guide member connected to the frame and having an eyelet movable in laterally spaced relation to the spindle axis, and a holder for holding the eyelet in an intermediate position thereof;

(d) momentarily elastically deforming the frame while engaging the opposite extremities of the spindle shaft with corresponding ones of the bearings;

(e) engaging a portion of the media with the eyelet;

(f) activating the holder for holding the eyelet approximately midway between opposite ends of the supply;

(g) placing the base on a horizontally disposed supporting surface with the spindle axis vertically disposed and the spindle shaft extending upwardly from the conical journal;

(h) performing hand work using the media, thereby advancing the media from the supply, through the eyelet as the spindle unit freely rotates;

(i) placing the base on the supporting surface with the spindle axis horizontally disposed;

(j) releasing the holder; and (k) moving the guide member for positioning the eyelet on opposite sides of the intermediate position while rotating the spindle unit for rewinding a portion of the media, thereby managing the media.

* * * * *